United States Patent [19]

Brice et al.

[11] Patent Number: 4,718,694

[45] Date of Patent: Jan. 12, 1988

[54] BACKCOUNTRY SKI BINDING

[75] Inventors: Ralph E. Brice, 15041 SE. 14th St., Bellevue, Wash. 98007; Ronald G. Green, Ephrata; Ronald L. Lawrence; James D. Miller, both of Renton, all of Wash.

[73] Assignee: Ralph E. Brice, Bellevue, Wash.

[21] Appl. No.: 770,848

[22] Filed: Aug. 29, 1985

[51] Int. Cl.[4] ..... A63C 7/10

[52] U.S. Cl. ..... 280/605; 280/614

[58] Field of Search ..... 280/605, 607, 614, 615, 280/618, 620, 809, 601

[56] References Cited

U.S. PATENT DOCUMENTS

| | | | |
|---|---|---|---|
| 1,101,631 | 6/1914 | Jacques | 280/605 |
| 2,077,660 | 4/1937 | Barieau | 280/604 |
| 2,120,363 | 6/1938 | Jerns, Jr. | 280/604 |
| 2,194,979 | 3/1940 | Jett | 280/605 |
| 2,208,214 | 7/1940 | Fortune | 280/605 |
| 2,316,252 | 4/1943 | Karlsson | 280/605 |
| 2,358,213 | 9/1944 | Courage | 280/604 |
| 2,375,943 | 5/1945 | Pape | 280/604 |
| 2,510,476 | 6/1950 | LaSalle | 280/604 |
| 3,003,777 | 10/1961 | Hilding | 280/614 |
| 3,433,494 | 3/1969 | Hinterholzer | 280/605 |
| 4,062,553 | 12/1977 | Riedel | 280/604 |
| 4,239,255 | 12/1980 | Boudreau et al. | 280/605 |
| 4,353,575 | 10/1982 | Brice | 280/614 |

FOREIGN PATENT DOCUMENTS

| | | | |
|---|---|---|---|
| 63927 | 3/1914 | Austria | 280/605 |
| 292861 | 7/1916 | Fed. Rep. of Germany | 280/605 |
| 591188 | 1/1934 | Fed. Rep. of Germany | 280/605 |
| 2508805 | 1/1983 | France | 280/605 |

OTHER PUBLICATIONS

Ski Flash Magazine, p. 74, vol. 43, Mar. 1980.

*Primary Examiner*—David M. Mitchell
*Attorney, Agent, or Firm*—Christensen, O'Connor, Johnson & Kindness

[57] ABSTRACT

A backcountry ski binding having a boot-receiving frame (10) and a climbing attachment (40) is detachably mountable (24, 26) upon a ski and convertible between a plurality of climbing modes (L) and a stored mode (C). The frame includes adjustable rear support means (28) that permit free heel operation at a plurality of boot positions to accommodate slopes of differing grade. The climbing attachment is pivotal about a main mounting pin and has an articulated plate (42) and arm (44) so that a climbing scoop (46) can be moved between not only the plurality of different climbing positions, but also between those positions and the stored position. Locking means (56, 58) are included to releasably and selectively lock the scoop in these positions.

7 Claims, 6 Drawing Figures

BACKCOUNTRY SKI BINDING

BACKGROUND OF THE INVENTION

The present invention relates generally to equipment for snow skiing and, more particularly, to a ski binding and a climbing attachment that are detachably mountable upon a ski and convertible between a plurality of climbing modes and a stored mode for backcountry skiing.

As used herein, the term "backcountry skiing" refers to an increasingly popular form of skiing that is done away from developed ski areas, usually in mountainous wilderness areas where there are no groomed slopes or trails or ski lifts. In this version of the sport (also known as "ski mountaineering"), the skier travels off-trail, ascending, descending, and traversing an ever changing variety of terrain, often under changing snow conditions. Ethusiasts frequently combine backcountry skiing with winter camping. Since, on such outings, the skier often ventures into remote areas laden with a heavy backpack, the performance and reliability of his equipment are critical.

For these reasons, most backcountry skiers perfer to use downhill skis, i.e., stiff, metal-edged skies, rather than lighter weight cross-country skis. A principal factor underlying this preference is the greater control and safety provided by the stiff boots and releasable bindings that are available for downhill skis.

Various forms of specialized bindings intended for backcountry use have been heretofore proposed. In one form, these bindings have provided some form of mechanism that can lock the heel of the boot into a tight, but releasable position for downhill skiing, and then unlock the heel to allow free movement thereof relative to the ski for moving cross-country or uphill.

In another known form, backcountry bindings have been configured so as to be cooperatively engageable with the releasable downhill bindings of a ski. Typically, such bindings include a platform that fits between the heel and the pieces of the release bindings and additional mechanisms that permit free heel operation. Since these bindings are releasable in the climbing mode, they are intended to provide safety. While binding release is essential to safety in a downhill mode of operation, such a feature can be dangerous when "hiking" or climbing uphill or above cliffs, trees, or other dangerous objects. In backcountry skiing, such an unwanted or unexpected release is often referred to as "pre-release".

In addition to creating the problem of pre-release, this type of binding can also disrupt the precise release setting of the downhill bindings, creating the risk of malfunction during subsequent downhill operation.

Since the bottom surfaces of downhill skis are designed to glide efficiently over the snow, they slip backwards easily during an ascent, even on moderate slopes. The overcome this problem, backcountry skiers use climbing skins for traction. These skins are typically attached to the underside of the ski using an adhesive. While satisfactory performance under some conditions can be obtained with such skins, there are distinct disadvantages. First, the adhesives used to attach the skins almost always leave a residue on the base of the ski. Consequently, the downhill skiing characteristics of the ski are impaired. Secondly, since the adhesive skins frequently become wet, it is extremely difficult, and often not possible, to reattach the skins to the ski once they have been removed. It will be appreciated that this is particularly disadvantageous in a deep backcountry setting. Finally, climbing skins have minimal effectiveness on icy surfaces.

The present invention provides an arrangement that overcomes the disadvantages of the developments described above. In particular, an important aspect of the invention is the provision of a detachable climbing device that will hold a skier on significantly steeper slopes than climbing skins and, thus, enable a skier to climb slopes more easily and faster. A further aspect of the invention is the provision of a backcountry binding that combines, in a single, detachable device, a pivotal backcountry binding and a climbing attachment that can be quickly and easily mounted and removed from skis.

SUMMARY OF THE INVENTION

In accordance with an aspect of the invention, there is provided a detachable backcountry binding that, although usable on any type of ski, is particularly suitable for use on a downhill ski having a binding with releasable toe- and heelpieces. Since the backcountry binding is detachable from the ski, the skier can revert to the downhill bindings for safe descents. The binding includes a frame having a foward end detachably mountable on a ski for supporting the forward portion of a ski boot above the upper surface of the ski. The frame includes means for holding a ski boot thereon and rear support means, which are engageable with the ski for supporting the rearward portion of the ski boot above the upper surface of the ski, while allowing the rearward portion of the boot to move freely upward. A climbing attachment is connected to the frame so as to be detachably mountable therewith on the ski. The climbing attachment includes a climbing member that is adapted to extend downward from the ski and engage the snow upon which the ski is used. According to an aspect of the invention, the climbing attachment is also useful independently of the frame on any type of ski.

In a preferred form, the climbing attachment is pivotally movable between a plurality of climbing positions. In each of these climbing positions, the climbing member is oriented at a predetermined inclination relative to the bottom of the ski. Means are included to releasably and selectively lock the climbing member in these climbing positions so that the skier can with ease control the amount of traction applied to the snow. In accordance with an aspect of the invention, it is desirable that the climbing attachment have a generally U-shaped shovel that is releasably lockable in a first climbing position in which it is inclined slightly rearward from a line drawn perpendicular to the base of the ski, and in a second position in which the shovel is laid flat against the base of the ski for travel on level terrain or for travel on frozen surfaces. For added traction in this latter position, it is preferred that the forward facing surface of the shovel have teeth for penetrating crusty snow and gripping on ice.

In accordance with an additional aspect of the invention, the climbing attachment is articulated so that it may be moved not only between a plurality of different climbing positions, but between those positions and a stored, out-of-the-way position adjacent the upper surface of the ski. With this arrangement, the skier can, without removing the binding, store the climbing attachment in the out-of-the-way position for skiing down short, shallow pitches and then quickly return to a climbing mode.

BRIEF DESCRIPTION OF THE DRAWINGS

The invention can be understood by the following portion of the specification, taken in conjunction with the accompanying drawings in which.

DETAILED DESCRIPTION OF THE INVENTION

Figure 1:
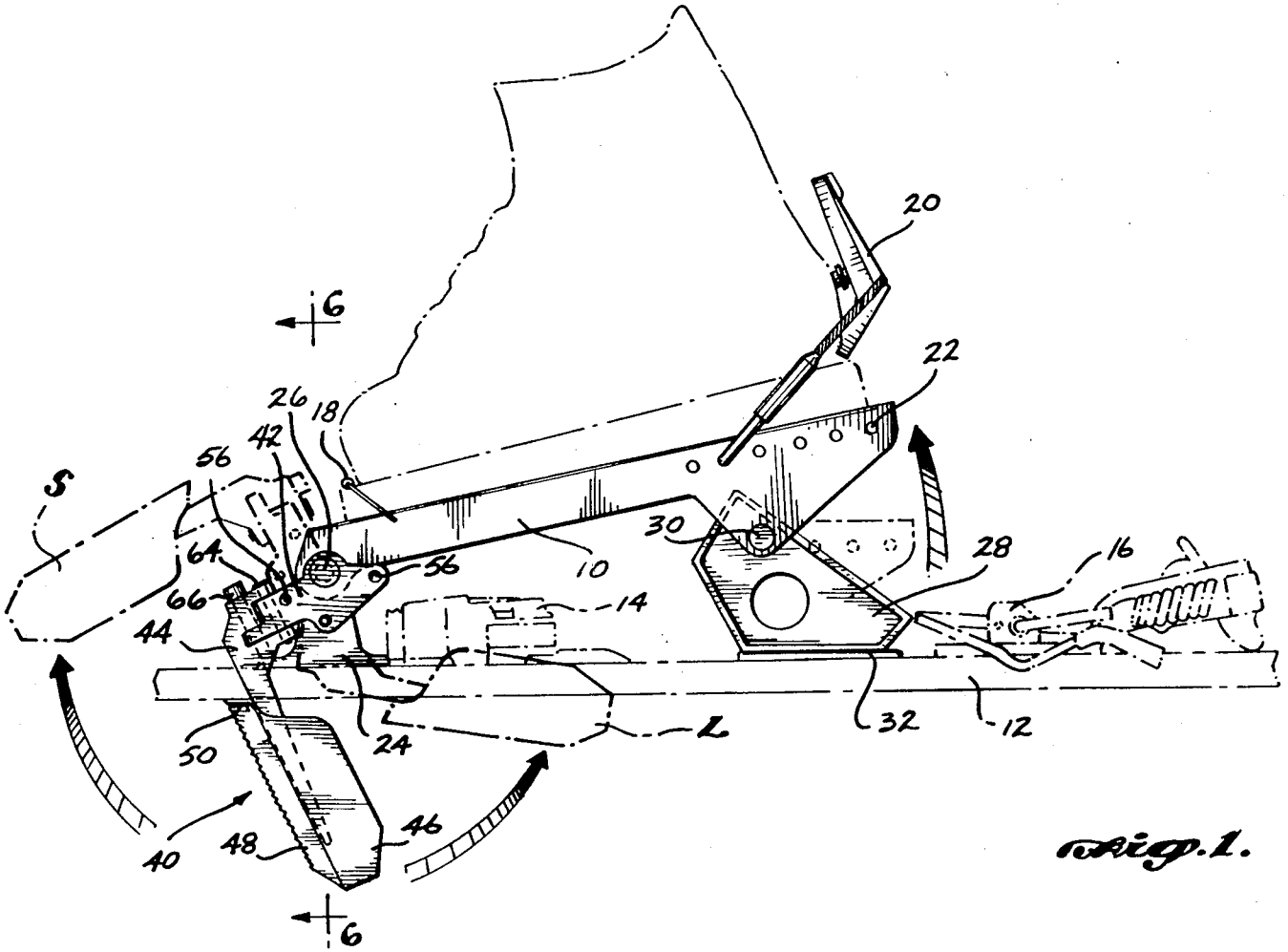
FIG. 1 is a side elevation of a binding according to the invention in position on a downhill ski.

In FIG. 1, a binding according to the invention comprising a frame 10 and a climbing attachment 40 is detachably mountable upon a ski 12. As indicated in reference line, the ski 12 includes a conventional downhill binding having a releasable toepiece 14 and a releasable heelpiece 16. The frame 10 has a loop-type toepiece 18 for holding the toe portion of a ski boot and a heelpiece 20 for holding the heel of the boot. To accommodate boots of different sizes, the heelpiece 20 is adjustably positionable in a plurality of apertures 22 formed in the frame.

The forward end of the frame is pivotally mounted to a pivot block 24 that is permanently secured to the ski 12 immediately in front of the releasable toepiece 14 of the downhill binding. As will be discussed in greater detail hereinafter, especially in conjunction with FIG. 6, both the frame 10 and the climbing attachment 40 are pivotally and releasably connected to the pivot block 24 by a slidable mounting pin 26.

The rear end of the frame 10 is supported in spaced relation to the upper surface of the ski by an adjustable rear support 28. As best seen in FIG. 1, the adjustable rear support 28 is pivotally connected by a pin 30 to the frame 10. The minimum elevation of the heel of the boot can be adjusted by rotating the rear support 28 until a desired one of its abutment faces engages a low-friction pad 32. In each of its various positions, the rear support 28 merely rests upon the low-friction pad 32 so that the frame 10 is permitted to freely rotate about the mounting pin 26. It will be appreciated that many other arrangements can be utilized for supporting the rearward portion of the ski boot in a desired elevation relative to the ski, as required for the efficiency and comfort of the skier on slopes of different inclination. In any such arrangement, it is desirable that the means for adjusting the elevation of the heel remain attached to the frame. Such an arrangement is preferred for ease and speed in switching from one setting to another and to ensure that there is no interfering structure left between the toe- and heelpieces, 14 and 16, respectively, when the binding is removed from the ski. In addition to maintaining the area between the heel- and toepieces clear for the boot when the ski is used for downhill skiing, the positioning of the binding illustrated in FIG. 1 (which results from placement of the pivot block 24) is preferred for additional reasons. First, this positioning places the pivot point for the frame well forward of the center of gravity. This makes climbing much easier, since the skier is not required to lift the entire ski with each step but, rather, need only lift the tip of the ski while allowing the tail to drag. Secondly, when positioned as shown in FIG. 1, none of the components of the backcountry binding contacts either the toe- or heelpieces of the downhill binding. As a result, there is no risk that operation of the backcountry binding will result in disturbance of the precise release settings of the downhill bindings so as to jeopardize the safety of the skier.

For effective travel in remote, alpine areas, the binding is provided with a climbing attachment 40 that is also detachably and pivotally mounted upon the ski. Preferably, the climbing attachment 40 and the frame are pivotally connected to one another and pivotally and releasably connectable to the pivot block by the mounting pin 26. With this arrangement, the frame and climbing attachment share a common axis about which they may be independently pivoted. As will become more apparent from the following discussion, this ability to independently move the frame and climbing attachment enables quick and easy adjustment of these components to fit a particular mode of use (e.g., climbing or traversing) without the necessity of removing the binding from the ski. The use of the preferred single mounting pin arrangement also allows the skier to easily remove and attach the binding as often as is necessary. This ease of operation particularly results since the frame and climbing attachment remain joined together as a single unit when removed from the ski. Importantly, when the interconnected frame and climbing attachment are removed from the ski, only the pivot block 24 remains connected to the ski. Since the pivot block is small in size and can be made from strong, lightweight materials, its presence on the ski will have virtually no effect upon the performance of the ski when it is used in the downhill mode of operation. Consequently, when the frame and climbing attachment are removed from the ski, the skier has a "clean" ski with high-performance release bindings.

Figure 3:
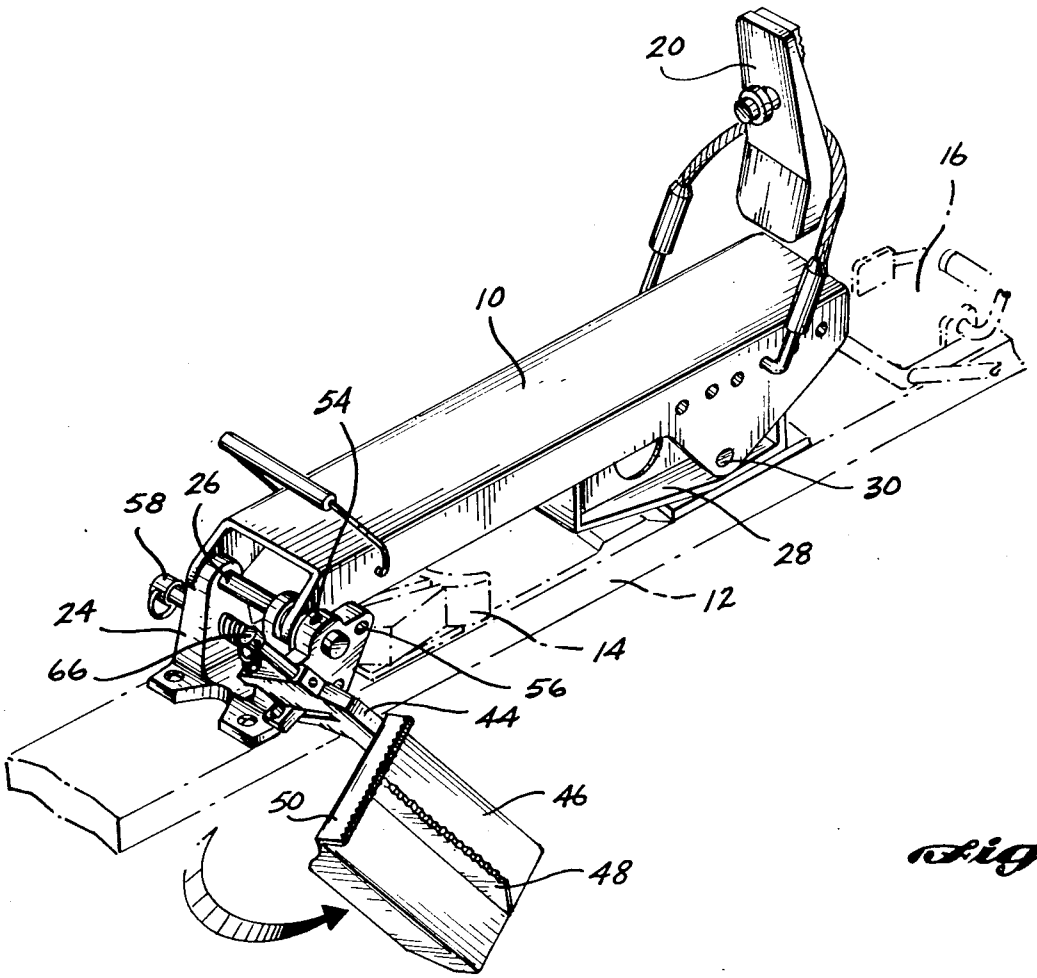
Figure 4:
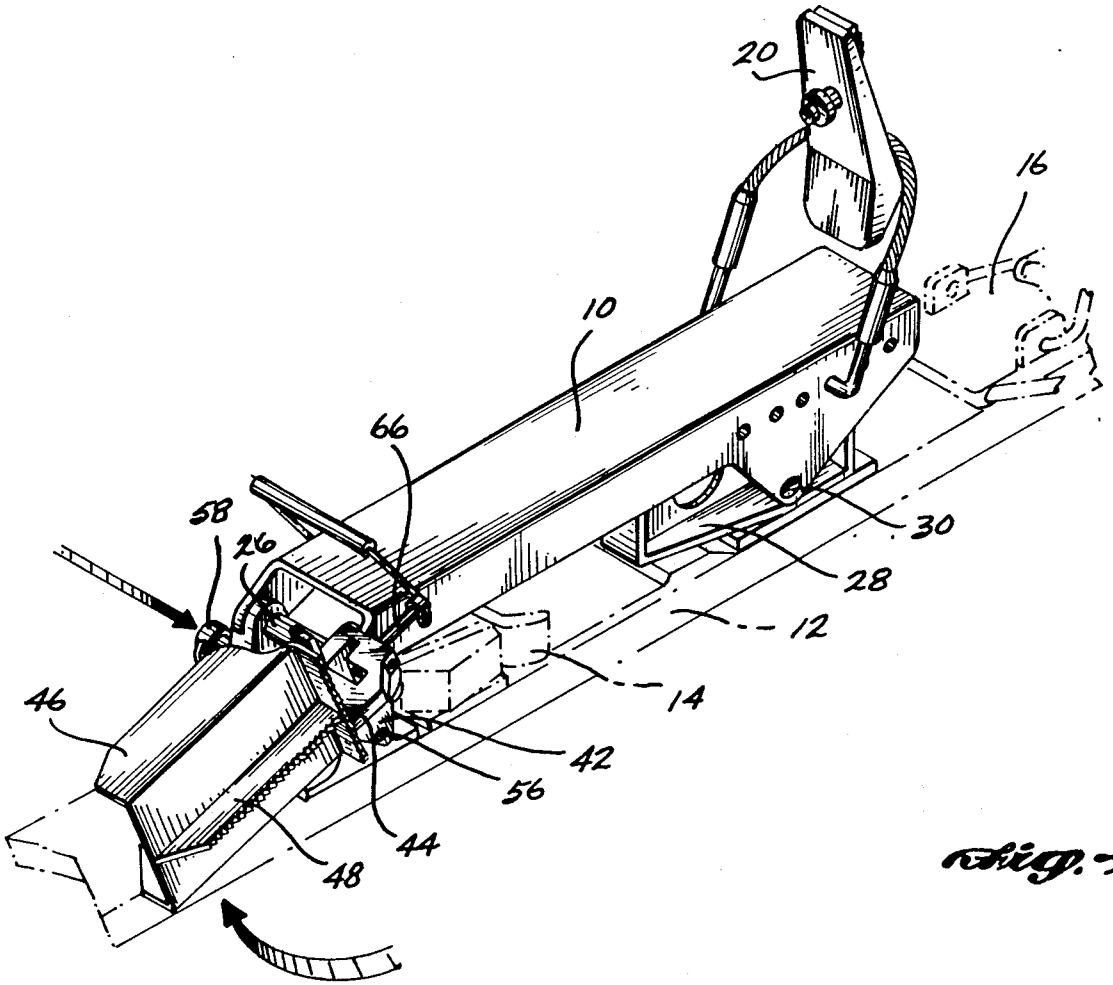

Referring again to FIG. 1, the climbing attachment 40 has three principal components, a quadrant plate 42, an arm 44, and a climbing member, or scoop, 46. The scoop is secured to the lower end of the arm 44 for positioning underneath and transversely across the ski, as seen more clearly in FIG. 6. The scoop has a general U-shape with a substantially flat central portion flanked by a pair of opposed side edges that extend rearwardly from the central portion in generally parallel relation to one another. The forward facing surface of the central portion of the scoop has a longitudinally extending keel 48 and a scalloped edge 50. The keel and scalloped edge each extend outward from the central portion of the scoop to join one another to form a "T" as seen best in FIG. 3. A plurality of teeth are formed on the outermost edges of the keel and scalloped edge to provide traction on ice and to penetrate crusty snow.

The quadrant plate 42 and arm 44 are articulated so that the scoop 46 can be releasably secured in one of a plurality of positions. In the embodiment illustrated herein, three such positions are shown. It is, of course, to be understood that the invention contemplates provision of fewer or more positions. Referring again to FIG. 1, the scoop 46 is shown in a climbing position that is used for ascending slopes. In this position, the scoop, i.e., the central portion thereof, is inclined relative to the base of the ski at an acute angle relative to a vertical or perpendicular line drawn through the bottom of the ski. A surface of the scalloped edge 50 engages the base of the ski so that some of the forces exerted on the scoop during climbing are transferred to the ski.

The climbing attachment 40 can be pivoted to another operative, climbing position in which the scoop 48 is positioned "flat" against the base of the ski as indicated by the reference lines designated L in FIG. 1. This level position L is used for traveling across substantially level surfaces or to climb when surface conditions, such as ice, make it difficult or unsafe to use the climbing attachment in its more vertical position. In addition, this position can be used in a gliding mode of operation to slowly and controllably descend slopes. It will be seen that, in the level position L, the teeth on the keel 48 and the scalloped edge 50 are positioned almost directly underneath the skier's center of gravity and thus, have their maximum effectiveness. As a result of this, and as a result of the T-shaped arrangement of the teeth, the danger of slipping sideways on a difficult, icy traverse is minimized.

Figure 5:
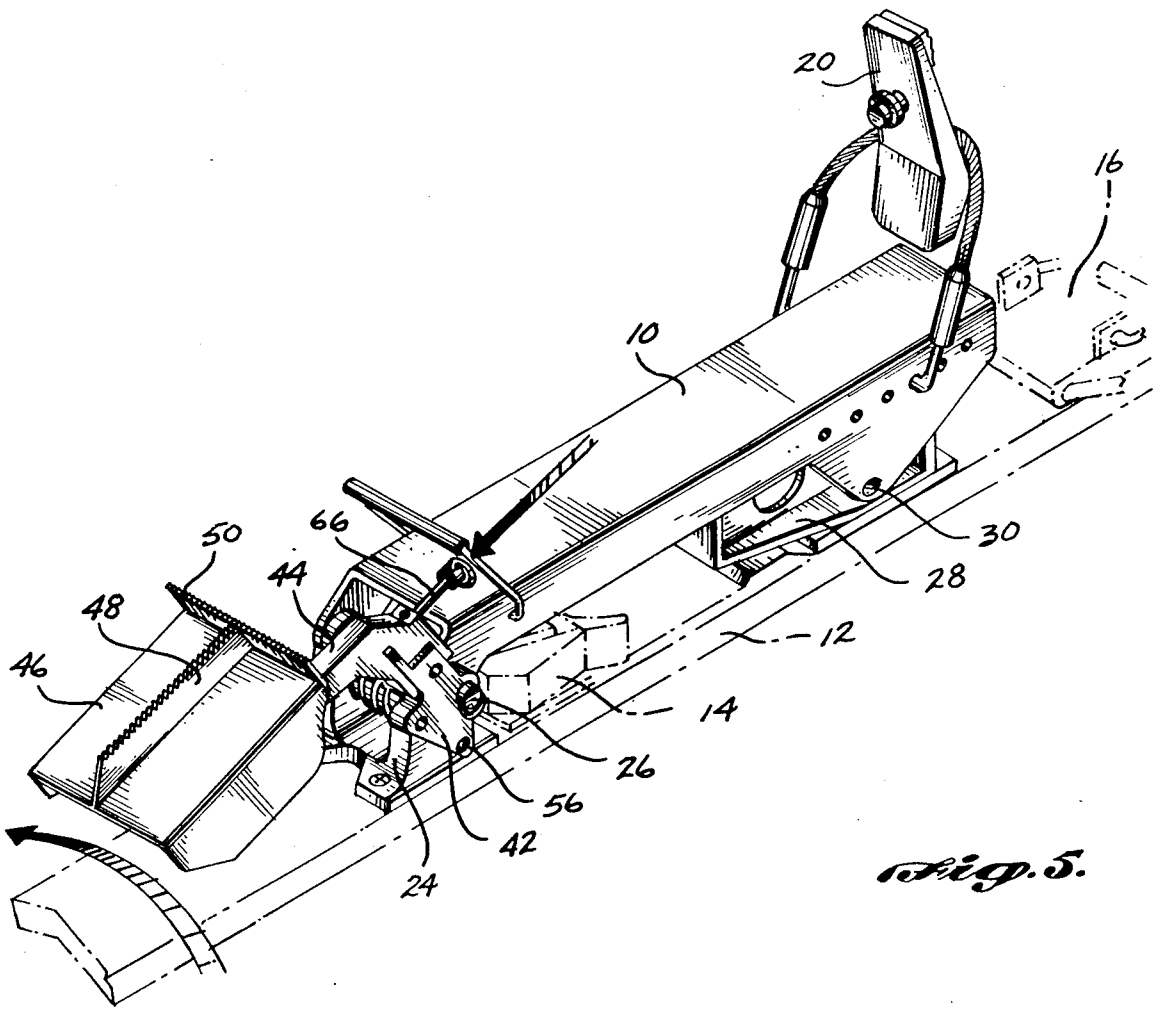

In backcountry ski travel, it is quite common for the skier to encounter small downhill slopes or short shallow pitches that are not long enough to justify completely removing the binding and utilizing the conventional releasable bindings in a downhill mode. To accommodate these conditions, the climbing attachment 40 is articulated in such a way that the scoop 46 may be quickly and easily moved from one of its operative positions underneath the ski to a stored, out-of-the-way position above the top of the ski. This position is shown in FIG. 5 and indicated in FIG. 1 by the reference line designated S.

Figure 2:
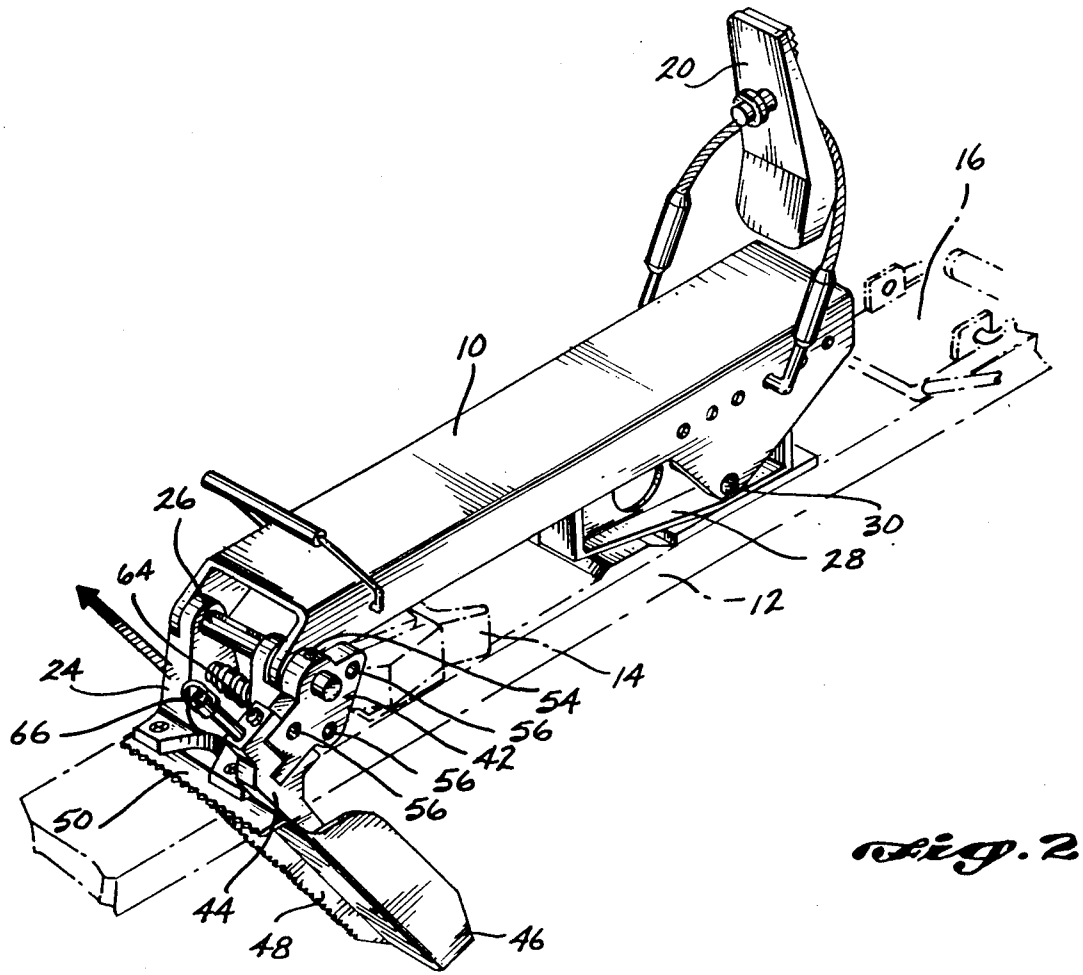
FIGS. 2 through 5 are respective views of the binding of FIG. 1, showing the sequential operation of the articulated climbing attachment.
Figure 6:
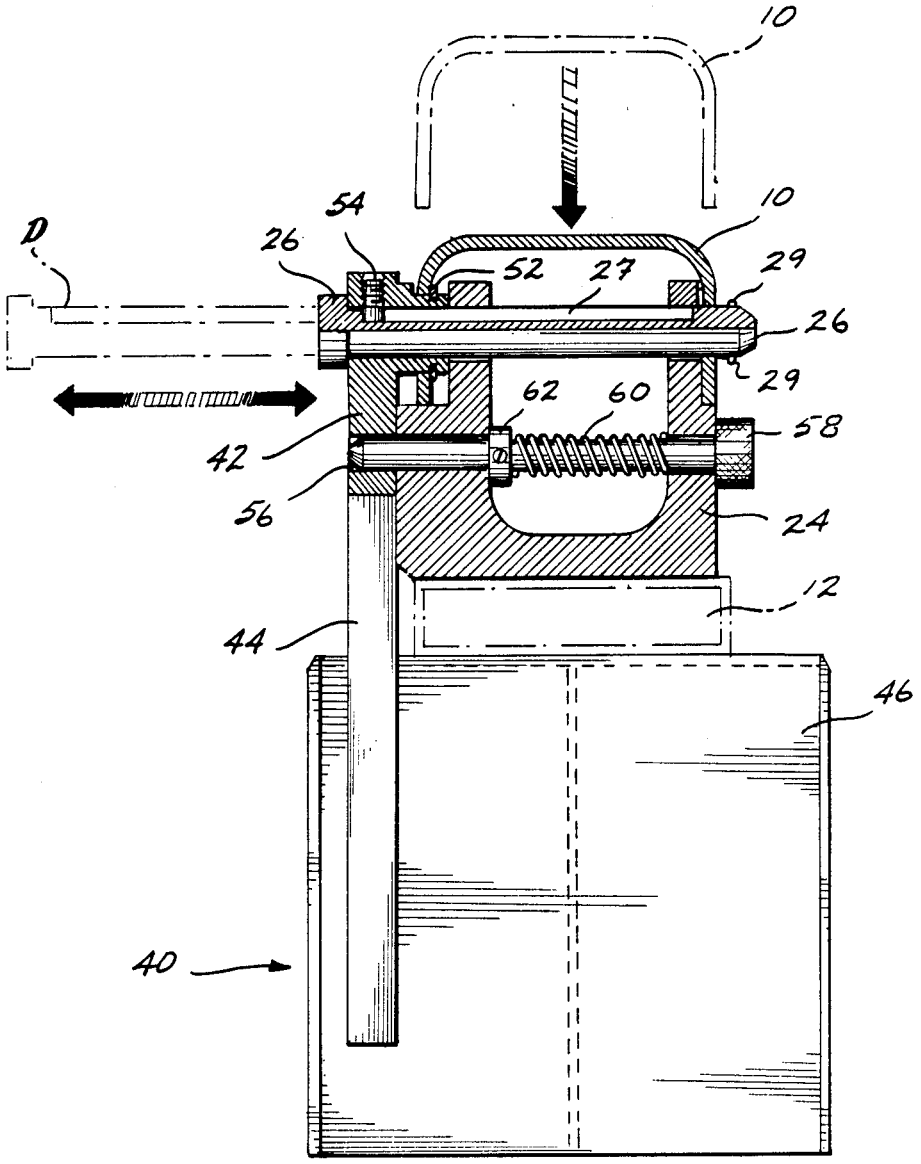
FIG. 6 is a partially broken cross-sectional rear elevation view taken along lines 6—6 of FIG. 1.

To enable movement of the climbing attachment between all of these positions, the quadrant plate is pivotally connectable to the pivot block 24, the arm 44 is pivotally connected to the quadrant plate, and means are provided for releasably locking both the quadrant plate and arm in the desired positions. Referring to FIG. 6, it will first be seen that the quadrant plate 42 has a barrel-shaped portion that extends through a complementarily configured opening formed in the frame 10. A locking washer 52 maintains the connection between the quadrant plate and frame, while permitting these two elements to pivot freely relative to one another. The mounting pin 26 is slidably received in a bore formed within the quadrant plate 42. The pin includes a channel 27 that cooperatively engages a set screw in such a manner that the mounting pin 26 is retained by the quadrant plate but free to slide from its mounted position to a detaching position as indicated by the reference lines designated D in FIG. 6. To detachably mount the frame and climbing attachment, the pivot block 24 has a pair of aligned bores that are formed opposite one another in two upstanding legs thereof as best seen in FIGS. 2 and 6. Recesses formed on the upper outer sides of these two legs receive the forward end of the frame to support the same and make it easy to align the various bores so that the mounting pin 26 may be inserted and withdrawn. When inserted as shown in FIG. 6, the mounting pin is prevented from inadvertent release by a pair of detents 29.

To lock the quadrant plate 26 in one of its three positions, three apertures 56 are formed therein. These apertures are cooperatively engaged by an adjustment pin 58 that is slidably mounted in the pivot block 24. The adjustment pin 58 is normally urged into engagement with the apertures of the quadrant plate by a spring 60 that bears against the inside of one of the legs of the pivot block and against a stop 62 that is connected to the adjustment pin.

Referring now to FIGS. 1 and 2, the arm 44 is pivotally connected to the quadrant plate 42 by an arm pivot pin 64. An arm-locking pin 66 is slidably mounted upon the arm 44 and is receivable by a corresponding bore formed in the forwardmost portion of the quadrant plate 42. The arm-locking pin 64 is preferably constructed in similar fashion to the mounting pin 26 having a channel that cooperatively engages a set screw so that the locking pin is always retained by the arm but free to slide into and out of locking engagement with the bore in the quadrant plate.

The operation of the articulated climbing attachment can best be understood by referring to FIGS. 2 through 5. These FIGURES illustrate the sequential positions occupied by the quadrant plate, arm, and scoop, in moving the climbing attachment from its principal climbing position (FIG. 2) to its stored position on top of the ski (FIG. 5). Before describing this sequence of operation, it is significant to observe that these movements are easily performed while the binding remains attached to the ski. Importantly, the components that must be moved to effect this operation (i.e., the arm-locking pin 66 and the adjustment pin 58) remain connected to the climbing attachment so that there is no risk that these parts will be inadvertently lost, for example, by dropping the same into deep powder snow.

With reference now to FIG. 2, the first step in movement of the attachment is to slide the arm-locking pin 66 upward to its stopped, withdrawn position. The arm and scoop are then rotated about the arm pivot pin 64 through an arc of approximately 90 degrees to the position shown in FIG. 3. With this movement, the entire scoop is now positioned laterally away from the side of the ski and ready to be rotated about the mounting pin 26 through another arc of approximately 90 degrees to the position shown in FIG. 4. To accomplish this movement, the adjustment pin 58 is laterally withdrawn from the aperture in the quadrant plate and the entire assembly is rotated in an upward direction. Since the adjustment pin 58 is resiliently biased toward, the quadrant plate, it automatically engages the rearwardmost aperture 56 when the quadrant plate is rotated to its final position. When this occurs, the arm and scoop assembly are again rotated about the arm pivot pin through another arc of approximately 90 degrees to arrive at the stored position shown in FIG. 5. Thereupon, the arm-locking pin 66 is slid back into locking engagement with the cooperating bore in the quadrant plate.

From the foregoing, it will also be understood how the scoop 46 is moved from its principal climbing position to the level position L in FIG. 1 simply by sliding the adjustment pin 58 sideways and by rotating the attachment until the adjustment pin engages the forwardmost aperture 56.

While a preferred embodiment of the invention has been illustrated and described, it will be understood that various modifications and alternative arrangements can be provided without departing from the inventive principles herein. For example, rather than having the pivot block permanently mounted upon the ski, it may be desirable to employ a clamping arrangement that makes the pivot block itself detachable from the ski. With such an arrangement, it would be possible to join the frame, the quadrant plate, and the pivot block as a single unit (rather than using a detachable connection such as mounting pin 26) so that the entire assembly may be mounted upon and detached from the ski.

Although it is desirable to employ a single mounting pin to mount the binding and provide a common axis about which the frame and climbing attachment rotate, it may be desirable to have the frame and climbing attachment mounted separately from one another, for example, on independent blocks. In this connection, it is to be understood that the climbing attachment is independently useful without the frame 10. For instance, some backcountry skiers prefer to use cross-country skis or specialized mountaineering skis, rather than downhill skis. Since the bindings normally used on such skis (including specialized backcountry-type bindings) permit free movement of the skier's heel, it is not necessary to provide the frame. Thus, for such applications, the climbing attachment along can be advantageously used to increase the skier's ability to climb steeper slopes and to handle icy conditions.

While, in the embodiment described herein, the arm axis about which the arm and scoop rotate is perpendicular to the common axis about which the quadrant plate and frame rotate, and is offset relative thereto, it is not necessary that these relationships always be maintained. As well, it is not necessary that the common axis provided by the mounting pin always be parallel to the ski bottom or top as illustrated herein.

While the articulated climbing attachment provides a high degree of performance and flexibility to meet a variety of conditions, circumstances of use may require only that the climbing attachment be positionable in one of the two climbing positions and not movable to the stored, out-of-the-way position. This would simplify the mechanism by removing the necessity for the pivotal connection between the arm and quadrant plate and thus be a more economical climbing attachment. By joining such an arrangement with a detachable pivot block, there would be provided a very useful climbing attachment that could advantageously be used by a ski shop on a rental basis, for example.

Finally, it is also possible to modify the climbing attachment so that either the scoop, or the scoop and arm assembly are removable. Advantageously, this would enable the use of variously sized scoops for varying snow conditions, for example, a larger scoop for powder snow. A skier heading into the backcountry could carry one or more of these differently sized scoops and thus be prepared for any conditions he might encounter.

One of ordinary skill, after reading the foregoing specification, will be able to effect various other modifications and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A detachable backcountry binding suitable for use on a ski of the type having a downhill binding with releasable toe and heel pieces, said binding comprising:

a frame having a forward end detachably mountable on the ski for supporting the forward portion of the ski boot above the upper surface of said ski, said frame including means for holding a ski boot thereon and rear support means engageable with the ski for supporting the rearward portion of the ski boot above the upper surface of said ski, said rear support means allowing the rearward portion of the boot to move freely upward;

a climbing attachment connected to said frame so as to be detachably mountable therewith on said ski, said climbing attachment including a climbing member that is adapted to extend downward from said ski and engage snow upon which said ski is used; and a pivot block, said pivot block being mountable on the ski forward of the toepiece, said frame and said climbing attachment being pivotally connected to one another and pivotally and releasably connectable to said pivot block for independent pivotal movement about a common axis.

2. The binding of claim 1, wherein said pivot block includes a bore that extends transversely across the ski in parallel relation to the bottom of said ski when said block is mounted thereon, and wherein said binding includes a mounting pin that is releasably receivable by the bore of said pivot block and pivotal therein, said mounting pin defining said common axis.

3. The binding of claim 1, wherein said climbing member is pivotally movable between a plurality of climbing positions, in each of said climbing positions, said climbing member extending downward from said ski at a predetermined inclination relative to the bottom of said ski, said binding including locking means for releasably and selectively locking said climbing member in said plurality of climbing positions, said climbing attachment including a quadrant plate and an arm, said climbing member being connected to said arm, said quadrant plate being pivotally connected to said frame for pivotal movement about said common axis, said arm being pivotally connected to said quadrant plate for pivotal movement about an arm axis, which is oriented at an angle relative to said common axis, whereby said climbing member is pivotal about both said common axis and said arm axis so as to be movable between said plurality of climbing positions and between said plurality of climbing positions and a stored position adjacent the upper surface of said ski, and wherein said locking means includes means for selectively locking said quadrant plate in a plurality of plate positions and means for selectively locking said arm in an arm position, selected combinations of said plate positions and said arm position corresponding to said plurality of climbing positions and said stored position.

4. The binding of claim 3, wherein said means for selectively locking said quadrant plate includes a plurality of apertures formed in said quadrant plate and an adjustment pin mounted on said pivot block, said adjustment pin being selectively movable into and out of engagement with the apertures of said quadrant plate to selectively and releasably lock said quadrant plate in said plurality of plate positions.

5. The binding of claim 4, wherein said means for selectively locking said arm includes a bore formed in said quadrant plate and an arm locking pin mounted on said arm, said arm locking pin being selectively movable into and out of the bore of said quadrant plate to selectively and releasably lock said arm in said plurality of arm positions.

6. The binding of claim 5, wherein said arm is pivotally connected to said quadrant plate by an arm pivot pin, said arm pivot pin defining said arm axis, said arm pivot pin being oriented relative to the mounting pin of said binding so that said arm axis is substantially perpendicular to said common axis.

7. A climbing attachment suitable for use on a snow ski, comprising:

a pivot block mountable on a snow ski;

a quadrant plate pivotally connectable to said pivot block for pivotal movement about a plate axis that is substantially parallel to the bottom surface of said ski;

an arm connected to said quadrant plate, said arm having a lower end that extends downward from the bottom of said ski, said arm being pivotally connected to said quadrant plate for pivotal movement about an arm axis that is oriented at an angle relative to said plate axis;

a scoop secured to the lower end of said arm so as to be positioned underneath and transversely across said ski for engagement with snow, said scoop being pivotally movable with said quadrant plate about said plate axis between a plurality of climbing positions, in each of said climbing positions, said scoop being oriented at a predetermined inclination relative to the bottom of said ski, said scoop being pivotal about both said plate axis and said arm axis so as to be movable between said plurality of climbing positions and between said plurality of climbing positions and a stored position adjacent the upper surface of said ski; and locking means for releasably and selectively locking said climbing element in said plurality of climbing positions, said locking means including a plurality of apertures formed in said quadrant plate and an adjustment pin mounted on said pivot block, said adjustment pin being selectively movable into and out of engagement with the apertures of said quadrant plate to selectively and releasably lock said quadrant plate in a plurality of plate positions corresponding to said climbing positions, said locking means including means for selectively locking said arm in an arm position, selected combinations of said arm position and said plate positions corresponding to said plurality of climbing positions and said stored position.

* * * * *